US009264808B2

(12) United States Patent
Zhou et al.

(10) Patent No.: US 9,264,808 B2
(45) Date of Patent: Feb. 16, 2016

(54) SYSTEMS AND METHODS FOR DETECTION AND CANCELLATION OF NARROW-BAND NOISE

(71) Applicant: Cirrus Logic, Inc., Austin, TX (US)

(72) Inventors: Dayong Zhou, Austin, TX (US); Yang Lu, Austin, TX (US)

(73) Assignee: Cirrus Logic, Inc., Austin, TX (US)

( * ) Notice: Subject to any disclaimer, the term of this patent is extended or adjusted under 35 U.S.C. 154(b) by 264 days.

(21) Appl. No.: 13/917,843

(22) Filed: Jun. 14, 2013

(65) Prior Publication Data

US 2014/0369517 A1 Dec. 18, 2014

(51) Int. Cl.
*G10K 11/178* (2006.01)
*H04R 3/00* (2006.01)

(52) U.S. Cl.
CPC ..... *H04R 3/005* (2013.01); *G10K 11/1784* (2013.01); *G10K 2210/108* (2013.01); *G10K 2210/503* (2013.01); *H04R 2460/01* (2013.01); *H04R 2499/11* (2013.01)

(58) Field of Classification Search
None
See application file for complete search history.

(56) References Cited

U.S. PATENT DOCUMENTS

| | | | |
|---|---|---|---|
| 5,251,263 | A | 10/1993 | Andrea et al. |
| 5,278,913 | A | 1/1994 | Delfosse et al. |
| 5,321,759 | A | 6/1994 | Yuan |
| 5,337,365 | A | 8/1994 | Hamabe et al. |
| 5,359,662 | A | 10/1994 | Yuan et al. |
| 5,410,605 | A | 4/1995 | Sawada et al. |
| 5,425,105 | A | 6/1995 | Lo et al. |
| 5,445,517 | A | 8/1995 | Kondou et al. |
| 5,465,413 | A | 11/1995 | Enge et al. |
| 5,481,615 | A | 1/1996 | Eatwell et al. |
| 5,548,681 | A | 8/1996 | Gleaves et al. |

(Continued)

FOREIGN PATENT DOCUMENTS

| | | | |
|---|---|---|---|
| DE | 102011013343 | A1 | 9/2012 |
| EP | 0412902 | A2 | 2/1991 |

(Continued)

OTHER PUBLICATIONS

Kuo, Sen and Tsai, Jianming, Residual noise shaping technique for active noise control systems, J. Acoust. Soc. Am. 95 (3), Mar. 1994, pp. 1665-1668.

Milani, et al., "On Maximum Achievable Noise Reduction in ANC Systems", Proceedings of the IEEE International Conference on Acoustics, Speech, and Signal Processing, ICASSP 2010, Mar. 14-19, 2010 pp. 349-352.

Ryan, et al., "Optimum near-field performance of microphone arrays subject to a far-field beampattern constraint", 2248 J. Acoust. Soc. Am. 108, Nov. 2000.

(Continued)

*Primary Examiner* — Brenda Bernardi
(74) *Attorney, Agent, or Firm* — Jackson Walker L.L.P.

(57) ABSTRACT

In accordance with methods and systems of the present disclosure, an integrated circuit for implementing at least a portion of a personal audio device may include an output including an anti-noise signal, a reference microphone input, an error microphone input, and a processing circuit. The processing circuit may implement an adaptive filter having a response that generates the anti-noise signal from the reference microphone signal to reduce the presence of the ambient audio sounds heard by the listener, wherein the processing circuit may implement a coefficient control block that shapes the response of the adaptive filter in conformity with the error microphone signal and the reference microphone signal by adapting the response of the adaptive filter in accordance with a calculated narrow-band-to-full-band ratio, wherein the narrow-band-to-full-band ratio is a function of a narrow-band power of the reference microphone signal divided by a full-band power of the reference microphone signal.

24 Claims, 3 Drawing Sheets

(56) References Cited

U.S. PATENT DOCUMENTS 5,586,190 A 12/1996 Trantow et al.
5,640,450 A 6/1997 Watanabe
5,668,747 A 9/1997 Ohashi
5,696,831 A 12/1997 Inanaga
5,699,437 A 12/1997 Finn
5,706,344 A 1/1998 Finn
5,740,256 A 4/1998 Castello Da Costa et al.
5,768,124 A 6/1998 Stothers et al.
5,815,582 A 9/1998 Claybaugh et al.
5,832,095 A 11/1998 Daniels
5,909,498 A 6/1999 Smith
5,940,519 A 8/1999 Kuo
5,946,391 A 8/1999 Dragwidge et al.
5,991,418 A 11/1999 Kuo
6,041,126 A 3/2000 Terai et al.
6,118,878 A 9/2000 Jones
6,219,427 B1 4/2001 Kates et al.
6,278,786 B1 8/2001 McIntosh
6,282,176 B1 8/2001 Hemkumar
6,418,228 B1 7/2002 Terai et al.
6,434,246 B1 8/2002 Kates et al.
6,434,247 B1 8/2002 Kates et al.
6,522,746 B1 2/2003 Marchok et al.
6,683,960 B1 1/2004 Fujii et al.
6,766,292 B1 7/2004 Chandran et al.
6,768,795 B2 7/2004 Feltstrom et al.
6,850,617 B1 2/2005 Weigand
6,940,982 B1 9/2005 Watkins
7,058,463 B1 6/2006 Ruha et al.
7,103,188 B1 9/2006 Jones
7,181,030 B2 2/2007 Rasmussen et al.
7,330,739 B2 2/2008 Somayajula
7,365,669 B1 4/2008 Melanson
7,466,838 B1 12/2008 Moseley
7,680,456 B2 3/2010 Muhammad et al.
7,742,790 B2 6/2010 Konchitsky et al.
7,817,808 B2 10/2010 Konchitsky et al.
7,885,417 B2 2/2011 Christoph
8,019,050 B2 9/2011 Mactavish et al.
8,249,262 B2 8/2012 Chua et al.
8,290,537 B2 10/2012 Lee et al.
8,325,934 B2 12/2012 Kuo
8,363,856 B2 1/2013 Lesso et al.
8,379,884 B2 2/2013 Horibe et al.
8,401,200 B2 3/2013 Tiscareno et al.
8,442,251 B2 5/2013 Jensen et al.
8,526,627 B2 9/2013 Asao et al.
8,848,936 B2 9/2014 Kwatra et al.
8,907,829 B1 12/2014 Naderi
8,908,877 B2 12/2014 Abdollahzadeh Milani et al.
8,948,407 B2 2/2015 Alderson et al.
8,958,571 B2 2/2015 Kwatra et al.
9,066,176 B2 6/2015 Hendrix et al.
2001/0053228 A1 12/2001 Jones
2002/0003887 A1 1/2002 Zhang et al.
2003/0063759 A1 4/2003 Brennan et al.
2003/0185403 A1 10/2003 Sibbald
2004/0047464 A1 3/2004 Yu et al.
2004/0165736 A1 8/2004 Hetherington et al.
2004/0167777 A1 8/2004 Hetherington et al.
2004/0176955 A1 9/2004 Farinelli, Jr. et al.
2004/0202333 A1 10/2004 Csermak et al.
2004/0264706 A1 12/2004 Ray et al.
2005/0004796 A1 1/2005 Trump et al.
2005/0018862 A1 1/2005 Fisher
2005/0117754 A1 6/2005 Sakawaki
2005/0207585 A1 9/2005 Christoph
2005/0240401 A1 10/2005 Ebenezer
2006/0035593 A1 2/2006 Leeds
2006/0069556 A1 3/2006 Nadjar et al.
2006/0153400 A1 7/2006 Fujita et al.
2007/0030989 A1 2/2007 Kates
2007/0033029 A1 2/2007 Sakawaki
2007/0038441 A1 2/2007 Inoue et al.
2007/0047742 A1 3/2007 Taenzer et al.
2007/0053524 A1 3/2007 Haulick et al.
2007/0076896 A1 4/2007 Hosaka et al.
2007/0154031 A1 7/2007 Avendano et al.
2007/0258597 A1 11/2007 Rasmussen et al.
2007/0297620 A1 12/2007 Choy
2008/0019548 A1 1/2008 Avendano
2008/0101589 A1 5/2008 Horowitz et al.
2008/0107281 A1 5/2008 Togami et al.
2008/0144853 A1 6/2008 Sommerfeldt et al.
2008/0177532 A1 7/2008 Greiss et al.
2008/0181422 A1 7/2008 Christoph
2008/0226098 A1 9/2008 Haulick et al.
2008/0240455 A1 10/2008 Inoue et al.
2008/0240457 A1 10/2008 Inoue et al.
2009/0012783 A1 1/2009 Klein
2009/0034748 A1 2/2009 Sibbald
2009/0041260 A1 2/2009 Jorgensen et al.
2009/0046867 A1 2/2009 Clemow
2009/0060222 A1 3/2009 Jeong et al.
2009/0080670 A1 3/2009 Solbeck et al.
2009/0086990 A1 4/2009 Christoph
2009/0136057 A1 5/2009 Taenzer
2009/0175466 A1 7/2009 Elko et al.
2009/0196429 A1 8/2009 Ramakrishnan et al.
2009/0220107 A1 9/2009 Every et al.
2009/0238369 A1 9/2009 Ramakrishnan et al.
2009/0245529 A1 10/2009 Asada et al.
2009/0254340 A1 10/2009 Sun et al.
2009/0290718 A1 11/2009 Kahn et al.
2009/0296965 A1 12/2009 Kojima
2009/0304200 A1 12/2009 Kim et al.
2009/0311979 A1 12/2009 Husted et al.
2010/0014683 A1 1/2010 Maeda et al.
2010/0014685 A1 1/2010 Wurm
2010/0061564 A1 3/2010 Clemow et al.
2010/0069114 A1 3/2010 Lee et al.
2010/0082339 A1 4/2010 Konchitsky et al.
2010/0098263 A1 4/2010 Pan et al.
2010/0098265 A1 4/2010 Pan et al.
2010/0124336 A1 5/2010 Shridhar et al.
2010/0124337 A1 5/2010 Wertz et al.
2010/0131269 A1 5/2010 Park et al.
2010/0150367 A1 6/2010 Mizuno
2010/0158330 A1 6/2010 Guissin et al.
2010/0166203 A1 7/2010 Peissig et al.
2010/0195838 A1 8/2010 Bright
2010/0195844 A1 8/2010 Christoph et al.
2010/0207317 A1 8/2010 Iwami et al.
2010/0246855 A1 9/2010 Chen
2010/0266137 A1 10/2010 Sibbald et al.
2010/0272276 A1 10/2010 Carreras et al.
2010/0272283 A1 10/2010 Carreras et al.
2010/0274564 A1 10/2010 Bakalos et al.
2010/0284546 A1 11/2010 DeBrunner et al.
2010/0291891 A1 11/2010 Ridgers et al.
2010/0296666 A1 11/2010 Lin
2010/0296668 A1 11/2010 Lee et al.
2010/0310086 A1 12/2010 Magrath et al.
2010/0316225 A1 12/2010 Saito et al.
2010/0322430 A1 12/2010 Isberg
2011/0007907 A1 1/2011 Park et al.
2011/0026724 A1 2/2011 Doclo
2011/0051483 A1 3/2011 Chang et al.
2011/0106533 A1 5/2011 Yu
2011/0129098 A1 6/2011 Delano et al.
2011/0130176 A1 6/2011 Magrath et al.
2011/0142247 A1 6/2011 Fellers et al.
2011/0144984 A1 6/2011 Konchitsky
2011/0150257 A1 6/2011 Jensen
2011/0158419 A1 6/2011 Theverapperuma et al.
2011/0206214 A1 8/2011 Christoph et al.
2011/0222698 A1 9/2011 Asao et al.
2011/0222701 A1 9/2011 Donaldson
2011/0249826 A1 10/2011 Van Leest
2011/0288860 A1 11/2011 Schevciw et al.
2011/0293103 A1 12/2011 Park et al.
2011/0299695 A1 12/2011 Nicholson
2011/0305347 A1 12/2011 Wurm
2011/0317848 A1 12/2011 Ivanov et al.

(56) References Cited

U.S. PATENT DOCUMENTS

| | | | | |
|---|---|---|---|---|
| 2012/0084080 | A1 | 4/2012 | Konchitsky et al. | |
| 2012/0135787 | A1 | 5/2012 | Kusunoki et al. | |
| 2012/0140917 | A1 | 6/2012 | Nicholson et al. | |
| 2012/0140942 | A1 | 6/2012 | Loeda | |
| 2012/0140943 | A1 | 6/2012 | Hendrix et al. | |
| 2012/0148062 | A1 | 6/2012 | Scarlett et al. | |
| 2012/0155666 | A1 | 6/2012 | Nair | |
| 2012/0170766 | A1 | 7/2012 | Alves et al. | |
| 2012/0207317 | A1 | 8/2012 | Abdollahzadeh Milani et al. | |
| 2012/0215519 | A1 | 8/2012 | Park et al. | |
| 2012/0250873 | A1 | 10/2012 | Bakalos et al. | |
| 2012/0259626 | A1 | 10/2012 | Li et al. | |
| 2012/0263317 | A1 | 10/2012 | Shin et al. | |
| 2012/0300958 | A1 | 11/2012 | Klemmensen | |
| 2012/0300960 | A1 | 11/2012 | Mackay et al. | |
| 2012/0308021 | A1* | 12/2012 | Kwatra et al. | 381/71.1 |
| 2012/0308024 | A1 | 12/2012 | Alderson et al. | |
| 2012/0308025 | A1 | 12/2012 | Hendrix et al. | |
| 2012/0308026 | A1 | 12/2012 | Kamath et al. | |
| 2012/0308027 | A1 | 12/2012 | Kwatra | |
| 2012/0308028 | A1 | 12/2012 | Kwatra et al. | |
| 2012/0310640 | A1 | 12/2012 | Kwatra et al. | |
| 2013/0010982 | A1 | 1/2013 | Elko et al. | |
| 2013/0083939 | A1 | 4/2013 | Fellers et al. | |
| 2013/0243198 | A1 | 9/2013 | Van Rumpt | |
| 2013/0243225 | A1 | 9/2013 | Yokota | |
| 2013/0272539 | A1 | 10/2013 | Kim et al. | |
| 2013/0287218 | A1 | 10/2013 | Alderson et al. | |
| 2013/0287219 | A1 | 10/2013 | Hendrix et al. | |
| 2013/0301842 | A1 | 11/2013 | Hendrix et al. | |
| 2013/0301846 | A1 | 11/2013 | Alderson et al. | |
| 2013/0301847 | A1 | 11/2013 | Alderson et al. | |
| 2013/0301848 | A1 | 11/2013 | Zhou et al. | |
| 2013/0301849 | A1 | 11/2013 | Alderson | |
| 2013/0315403 | A1* | 11/2013 | Samuelsson | 381/56 |
| 2013/0343556 | A1 | 12/2013 | Bright | |
| 2013/0343571 | A1 | 12/2013 | Rayala et al. | |
| 2014/0044275 | A1 | 2/2014 | Goldstein et al. | |
| 2014/0050332 | A1 | 2/2014 | Nielsen et al. | |
| 2014/0051483 | A1 | 2/2014 | Schoerkmaier | |
| 2014/0072135 | A1* | 3/2014 | Bajic et al. | 381/71.11 |
| 2014/0086425 | A1 | 3/2014 | Jensen et al. | |
| 2014/0169579 | A1 | 6/2014 | Azmi | |
| 2014/0177851 | A1 | 6/2014 | Kitazawa et al. | |
| 2014/0211953 | A1 | 7/2014 | Alderson et al. | |
| 2014/0226827 | A1 | 8/2014 | Abdollahzadeh Milani et al. | |
| 2014/0270223 | A1 | 9/2014 | Li et al. | |
| 2014/0270224 | A1 | 9/2014 | Zhou et al. | |
| 2014/0277022 | A1 | 9/2014 | Hendrix et al. | |
| 2014/0294182 | A1 | 10/2014 | Axelsson | |
| 2014/0307887 | A1 | 10/2014 | Alderson et al. | |
| 2014/0307888 | A1 | 10/2014 | Alderson et al. | |
| 2014/0307890 | A1 | 10/2014 | Zhou et al. | |
| 2014/0307899 | A1 | 10/2014 | Hendrix et al. | |
| 2014/0314244 | A1 | 10/2014 | Yong et al. | |
| 2014/0314246 | A1 | 10/2014 | Hellmann | |
| 2014/0314247 | A1 | 10/2014 | Zhang | |
| 2014/0369517 | A1 | 12/2014 | Zhou et al. | |
| 2015/0078572 | A1 | 3/2015 | Abdollahzadeh Milani et al. | |
| 2015/0092953 | A1 | 4/2015 | Abdollahzadeh Milani et al. | |
| 2015/0104032 | A1 | 4/2015 | Kwatra et al. | |
| 2015/0161980 | A1 | 6/2015 | Alderson et al. | |
| 2015/0161981 | A1 | 6/2015 | Kwatra | |
| 2015/0163592 | A1 | 6/2015 | Alderson | |

FOREIGN PATENT DOCUMENTS

| | | | |
|---|---|---|---|
| EP | 1880699 | A2 | 1/2008 |
| EP | 1947642 | A1 | 7/2008 |
| EP | 2133866 | A1 | 12/2009 |
| EP | 2216774 | A1 | 8/2011 |
| EP | 239550 | A1 | 12/2011 |
| EP | 2395501 | A1 | 12/2011 |
| EP | 2551845 | A1 | 1/2013 |
| EP | 2583074 | A1 | 4/2013 |
| GB | 2401744 | A | 11/2004 |
| GB | 2436657 | A | 10/2007 |
| GB | 2455821 | A | 6/2009 |
| GB | 2455824 | A | 6/2009 |
| GB | 2455828 | A | 6/2009 |
| GB | 2484722 | A | 4/2012 |
| JP | H06186985 | A | 7/1994 |
| JP | 07325588 | | 12/1995 |
| WO | 03015074 | A1 | 2/2003 |
| WO | 03015275 | A1 | 2/2003 |
| WO | WO2004009007 | A1 | 1/2004 |
| WO | 2004017303 | A1 | 2/2004 |
| WO | 2006128768 | A1 | 12/2006 |
| WO | 2007007916 | A1 | 1/2007 |
| WO | 2007011337 | A1 | 1/2007 |
| WO | 2007113487 | A1 | 11/2007 |
| WO | 2010117714 | A1 | 10/2010 |
| WO | 2012107561 | A1 | 8/2012 |
| WO | 2012119808 | A2 | 9/2012 |
| WO | 2012134874 | A1 | 10/2012 |
| WO | 2012166388 | A2 | 12/2012 |
| WO | 2014158475 | A1 | 10/2014 |
| WO | 2014168685 | A2 | 10/2014 |
| WO | 2014172005 | A1 | 10/2014 |
| WO | 2014172006 | A1 | 10/2014 |
| WO | 2014172010 | A1 | 10/2014 |
| WO | 2014172019 | A1 | 10/2014 |
| WO | 2014172021 | A1 | 10/2014 |
| WO | 2014200787 | A1 | 12/2014 |
| WO | 2015038255 | A1 | 3/2015 |
| WO | 2015088639 | A | 6/2015 |
| WO | 2015088651 | A1 | 6/2015 |
| WO | 2015088653 | A1 | 6/2015 |

OTHER PUBLICATIONS

Cohen, et al., "Noise Estimation by Minima Controlled Recursive Averaging for Robust Speech Enhancement", IEEE Signal Processing Letters, vol. 9, No. 1, Jan. 2002.

Martin, "Noise Power Spectral Density Estimation Based on Optimal Smoothing and Minimum Statistics", IEEE Trans. on Speech and Audio Processing, col. 9, No. 5, Jul. 2001.

Martin, "Spectral Subtraction Based on Minimum Statistics", Proc. 7th EUSIPCO '94, Edinburgh, U.K., Sep. 13-16, 1994, pp. 1182-1195.

Cohen, "Noise Spectrum Estimation in Adverse Environments: Improved Minima Controlled Recursive Averaging", IEEE Trans. on Speech & Audio Proc., vol. 11, Issue 5, Sep. 2003.

Black, John W., "An Application of Side-Tone in Subjective Tests of Microphones and Headsets", Project Report No. NM 001 064.01.20, Research Report of the U.S. Naval School of Aviation Medicine, Feb. 1, 1954, 12 pages (pp. 1-12 in pdf), Pensacola, FL, US.

Lane, et al., "Voice Level: Autophonic Scale, Perceived Loudness, and the Effects of Sidetone", The Journal of the Acoustical Society of America, Feb. 1961, pp. 160-167, vol. 33, No. 2., Cambridge, MA, US.

Liu, et al., "Compensatory Responses to Loudness-shifted Voice Feedback During Production of Mandarin Speech", Journal of the Acoustical Society of America, Oct. 2007, pp. 2405-2412, vol. 122, No. 4.

Paepcke, et al., "Yelling in the Hall: Using Sidetone to Address a Problem with Mobile Remote Presence Systems", Symposium on User Interface Software and Technology, Oct. 16-19, 2011, 10 pages (pp. 1-10 in pdf), Santa Barbara, CA, US.

Peters, Robert W., "The Effect of High-Pass and Low-Pass Filtering of Side-Tone Upon Speaker Intelligibility", Project Report No. NM 001 064.01.25, Research Report of the U.S. Naval School of Aviation Medicine, Aug. 16, 1954, 13 pages (pp. 1-13 in pdf), Pensacola, FL, US.

Therrien, et al., "Sensory Attenuation of Self-Produced Feedback: The Lombard Effect Revisited", PLOS One, Nov. 2012, pp. 1-7, vol. 7, Issue 11, e49370, Ontario, Canada.

Campbell, Mikey, "Apple looking into self-adjusting earbud headphones with noise cancellation tech", Apple Insider, Jul. 4, 2013, pp. 1-10 (10 pages in pdf), downloaded on May 14, 2014 from http://

(56) References Cited

OTHER PUBLICATIONS appleinsider.com/articles/13/07/04/apple-looking-into-self-adjusting-earbud-headphones-with-noise-cancellation-tech.
International Patent Application No. PCT/US2014/017096, International Search Report and Written Opinion, May 27, 2014, 11 pages.
Jin, et al., "A simultaneous equation method-based online secondary path modeling algorithm for active noise control", Journal of Sound and Vibration, Apr. 25, 2007, pp. 455-474, vol. 303, No. 3-5, London, GB.
Erkelens et al., "Tracking of Nonstationary Noise Based on Data-Driven Recursive Noise Power Estimation", IEEE Transactions on Audio Speech, and Language Processing, vol. 16, No. 6, Aug. 2008.
Rao et al., "A Novel Two Stage Single Channle Speech Enhancement Technique", India Conference (INDICON) 2011 Annual IEEE, IEEE, Dec. 15, 2011.
Rangachari et al., "A noise-estimation algorithm for highly non-stationary environments" Speech Communication, Elsevier Science Publishers, vol. 48, No. 2, Feb. 1, 2006.
International Search Report and Written Opinion of the International Searching Authority, International Patent Application No. PCT/US2014/017343, mailed Aug. 8, 2014, 22 pages.
International Search Report and Written Opinion of the International Searching Authority, International Patent Application No. PCT/US2014/018027, mailed Sep. 4, 2014, 14 pages.
International Search Report and Written Opinion of the International Searching Authority, International Patent Application No. PCT/US2014/017374, mailed Sep. 8, 2014, 13 pages.
International Search Report and Written Opinion of the International Searching Authority, International Patent Application No. PCT/US2014/019395, mailed Sep. 9, 2014, 14 pages.
International Search Report and Written Opinion of the International Searching Authority, International Patent Application No. PCT/US2014/019469, mailed Sep. 12, 2014, 13 pages.
Feng, Jinwei et al., "A broadband self-tuning active noise equaliser", Signal Processing, Elsevier Science Publishers B.V. Amsterdam, NL, vol. 62, No. 2, Oct. 1, 1997, pp. 251-256.
Zhang, Ming et al., "A Robust Online Secondary Path Modeling Method with Auxiliary Noise Power Scheduling Strategy and Norm Constraint Manipulation", IEEE Transactions on Speech and Audio Processing, IEEE Service Center, New York, NY, vol. 11, No. 1, Jan. 1, 2003.
Lopez-Gaudana, Edgar et al., "A hybrid active noise cancelling with secondary path modeling", 51st Midwest Symposium on Circuits and Systems, 2008, MWSCAS 2008, Aug. 10, 2008, pp. 277-280.
International Patent Application No. PCT/US2014/049600, International Search Report and Written Opinion, Jan. 14, 2015, 12 pages.
International Patent Application No. PCT/US2014/061753, International Search Report and Written Opinion, Feb. 9, 2015, 8 pages.
International Patent Application No. PCT/US2014/061548, International Search Report and Written Opinion, Feb. 12, 2015, 13 pages.
International Patent Application No. PCT/US2014/060277, International Search Report and Written Opinion, Mar. 9, 2015, 11 pages.
Pfann, et al., "LMS Adaptive Filtering with Delta-Sigma Modulated Input Signals," IEEE Signal Processing Letters, Apr. 1998, pp. 95-97, vol. 5, No. 4, IEEE Press, Piscataway, NJ.
Toochinda, et al. "A Single-Input Two-Output Feedback Formulation for ANC Problems," Proceedings of the 2001 American Control Conference, Jun. 2001, pp. 923-928, vol. 2, Arlington, VA.
Kuo, et al., "Active Noise Control: A Tutorial Review," Proceedings of the IEEE, Jun. 1999, pp. 943-973, vol. 87, No. 6, IEEE Press, Piscataway, NJ.
Johns, et al., "Continuous-Time LMS Adaptive Recursive Filters," IEEE Transactions on Circuits and Systems, Jul. 1991, pp. 769-778, vol. 38, No. 7, IEEE Press, Piscataway, NJ.
Shoval, et al., "Comparison of DC Offset Effects in Four LMS Adaptive Algorithms," IEEE Transactions on Circuits and Systems II: Analog and Digital Processing, Mar. 1995, pp. 176-185, vol. 42, Issue 3, IEEE Press, Piscataway, NJ.
Mali, Dilip, "Comparison of DC Offset Effects on LMS Algorithm and its Derivatives," International Journal of Recent Trends in Engineering, May 2009, pp. 323-328, vol. 1, No. 1, Academy Publisher.
Kates, James M., "Principles of Digital Dynamic Range Compression," Trends in Amplification, Spring 2005, pp. 45-76, vol. 9, No. 2, Sage Publications.
Gao, et al., "Adaptive Linearization of a Loudspeaker," IEEE International Conference on Acoustics, Speech, and Signal Processing, Apr. 14-17, 1991, pp. 3589-3592, Toronto, Ontario, CA.
Silva, et al., "Convex Combination of Adaptive Filters With Different Tracking Capabilities," IEEE International Conference on Acoustics, Speech, and Signal Processing, Apr. 15-20, 2007, pp. III 925-928, vol. 3, Honolulu, HI, USA.
Akhtar, et al., "A Method for Online Secondary Path Modeling in Active Noise Control Systems," IEEE International Symposium on Circuits and Systems, May 23-26, 2005, pp. 264-267, vol. 1, Kobe, Japan.
Davari, et al., "A New Online Secondary Path Modeling Method for Feedforward Active Noise Control Systems," IEEE International Conference on Industrial Technology, Apr. 21-24, 2008, pp. 1-6, Chengdu, China.
Lan, et al., "An Active Noise Control System Using Online Secondary Path Modeling With Reduced Auxiliary Noise," IEEE Signal Processing Letters, Jan. 2002, pp. 16-18, vol. 9, Issue 1, IEEE Press, Piscataway, NJ.
Liu, et al., "Analysis of Online Secondary Path Modeling With Auxiliary Noise Scaled by Residual Noise Signal," IEEE Transactions on Audio, Speech and Language Processing, Nov. 2010, pp. 1978-1993, vol. 18, Issue 8, IEEE Press, Piscataway, NJ.
D. Senderowicz et al., "Low-Voltage Double-Sampled Delta-Sigma Converters," IEEE J. Solid-State Circuits, vol. 37, pp. 1215-1225, Dec. 1997, 13 pages.
P.J. Hurst and K.C. Dyer, "An improved double sampling scheme for switched-capacitor delta-sigma modulators," IEEE Int. Symp. Circuits Systems, May 1992, vol. 3, pp. 1179-1182, 4 pages.
Lopez-Caudana, Edgar Omar, Active Noise Cancellation: The Unwanted Signal and the Hybrid Solution, Adaptive Filtering Applications, Dr. Lino Garcia, ISBN: 978-953-307-306-4, InTech.
Booji, P.S., Berkhoff, A.P., Virtual sensors for local, three dimensional, broadband multiple-channel active noise control and the effects on the quiet zones, Proceedings of ISMA2010 including USD2010, pp. 151-166.
Kuo, Sen M. and Morgan, Dennis R., Active Noise Control Systems: A Tutorial Review, Proc. IEEE, vol. 87, No. 6, pp. 943-973, Jun. 1999.
Pfann, Eugen and Stewart, Robert W., LMS Adaptive Filtering with Sigma-Delta Modulated Signals, IEEE Signal Processing Letters, vol. 5, No. 4, pp. 95-97, Apr. 1998.
Widrow, B. et al., Adaptive Noise Cancelling: Principles and Applications, Proceedings of the IEEE, IEEE, New York, NY, U.S., vol. 63, No. 13, Dec. 1975, pp. 1692-1716.
Morgan, Dennis R. et al., A Delayless Subband Adaptive Filter Architecture, IEEE Transactions on Signal Processing, IEEE Service Center, New York, NY, U.S., vol. 43, No. 8, Aug. 1995, pp. 1819-1829.
International Patent Application No. PCT/US2014/040999, International Search Report and Written Opinion, Oct. 18, 2014, 12 pages.
International Patent Application No. PCT/US2013/049407, International Search Report and Written Opinion, Jun. 18, 2014, 13 pages.
Ray, Laura et al., Hybrid Feedforward-Feedback Active Noise Reduction for Hearing Protection and Communication, The Journal of the Acoustical Society of America, American Institute of Physics for the Acoustical Society of America, New York, NY, vol. 120, No. 4, Jan. 2006, pp. 2026-2036.
International Patent Application No. PCT/US2014/017112, International Search Report and Written Opinion, May 8, 2015, 22 pages.
International Patent Application No. PCT/US2015/035073, International Search Report and Written Opinion, Oct. 8, 2015, 22 pages.

* cited by examiner

SYSTEMS AND METHODS FOR DETECTION AND CANCELLATION OF NARROW-BAND NOISE

FIELD OF DISCLOSURE

The present disclosure relates in general to adaptive noise cancellation in connection with an acoustic transducer, and more particularly, to detection and cancellation of ambient narrow-band noise present in the vicinity of the acoustic transducer.

BACKGROUND

Wireless telephones, such as mobile/cellular telephones, cordless telephones, and other consumer audio devices, such as mp3 players, are in widespread use. Performance of such devices with respect to intelligibility can be improved by providing noise canceling using a microphone to measure ambient acoustic events and then using signal processing to insert an anti-noise signal into the output of the device to cancel the ambient acoustic events.

Because the acoustic environment around personal audio devices, such as wireless telephones, can change dramatically, depending on the sources of noise that are present and the position of the device itself, it is desirable to adapt the noise canceling to take into account such environmental changes. However, adaptive noise canceling circuits can be complex, consume additional power, and can generate undesirable results under certain circumstances. For example, some users of personal audio devices which include adaptive noise canceling circuitry report discomfort when using such devices while traveling in a vehicle, such discomfort including dizziness, disorientation, and pressure sensations.

SUMMARY

In accordance with the teachings of the present disclosure, the disadvantages and problems associated with detection and reduction of ambient narrow-band noise associated with an acoustic transducer may be reduced or eliminated.

In accordance with embodiments of the present disclosure, a personal audio device may include a personal audio device housing, a transducer, a reference microphone, an error microphone, and a processing circuit. The transducer may be mounted on the housing for reproducing an audio signal including both source audio for playback to a listener and an anti-noise signal for countering the effects of ambient audio sounds in an acoustic output of the transducer. The reference microphone may be mounted on the housing for providing a reference microphone signal indicative of the ambient audio sounds. The error microphone may be mounted on the housing in proximity to the transducer for providing an error microphone signal indicative of the acoustic output of the transducer and the ambient audio sounds at the transducer. The processing circuit may implement an adaptive filter having a response that generates the anti-noise signal from the reference microphone signal to reduce the presence of the ambient audio sounds heard by the listener, wherein the processing circuit may implement a coefficient control block that shapes the response of the adaptive filter in conformity with the error microphone signal and the reference microphone signal by adapting the response of the adaptive filter in accordance with a calculated narrow-band-to-full-band ratio, wherein the narrow-band-to-full-band ratio is a function of a narrow-band power of the reference microphone signal divided by a full-band power of the reference microphone signal.

In accordance with these and other embodiments of the present disclosure, a method for canceling ambient audio sounds in the proximity of a transducer of a personal audio device may include measuring ambient audio sounds with a reference microphone to produce a reference microphone signal. The method may also include measuring an output of the transducer and the ambient audio sounds at the transducer with an error microphone. The method may additionally include adaptively generating an anti-noise signal from a result of the measuring with the reference microphone and the measuring with the error microphone for countering the effects of ambient audio sounds at an acoustic output of the transducer by adapting a response of an adaptive filter that filters an output of the reference microphone in accordance with a calculated narrow-band-to-full-band ratio, wherein the narrow-band-to-full-band ratio is a function of a narrow-band power of the reference microphone signal divided by a full-band power of the reference microphone signal. The method may further include combining the anti-noise signal with a source audio signal to generate an audio signal provided to the transducer.

In accordance with these and other embodiments of the present disclosure, an integrated circuit for implementing at least a portion of a personal audio device may include an output, a reference microphone input, and error microphone input, and a processing circuit. The output may be for providing a signal to a transducer including both source audio for playback to a listener and an anti-noise signal for countering the effect of ambient audio sounds in an acoustic output of the transducer. The reference microphone input may be for receiving a reference microphone signal indicative of the ambient audio sounds. The error microphone input may be for receiving an error microphone signal indicative of the output of the transducer and the ambient audio sounds at the transducer. The processing circuit may implement an adaptive filter having a response that generates the anti-noise signal from the reference microphone signal to reduce the presence of the ambient audio sounds heard by the listener, wherein the processing circuit may implement a coefficient control block that shapes the response of the adaptive filter in conformity with the error microphone signal and the reference microphone signal by adapting the response of the adaptive filter in accordance with a calculated narrow-band-to-full-band ratio, wherein the narrow-band-to-full-band ratio is a function of a narrow-band power of the reference microphone signal divided by a full-band power of the reference microphone signal.

Technical advantages of the present disclosure may be readily apparent to one of ordinary skill in the art from the figures, description and claims included herein. The objects and advantages of the embodiments will be realized and achieved at least by the elements, features, and combinations particularly pointed out in the claims.

It is to be understood that both the foregoing general description and the following detailed description are examples and explanatory and are not restrictive of the claims set forth in this disclosure.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

The present disclosure encompasses noise canceling techniques and circuits that can be implemented in a personal audio device, such as a wireless telephone. The personal audio device includes an ANC circuit that may measure the ambient acoustic environment and generate a signal that is injected in the speaker (or other transducer) output to cancel ambient acoustic events. A reference microphone may be provided to measure the ambient acoustic environment and an error microphone may be included for controlling the adaptation of the anti-noise signal to cancel the ambient audio sounds and for correcting for the electro-acoustic path from the output of the processing circuit through the transducer.

Figure 1:
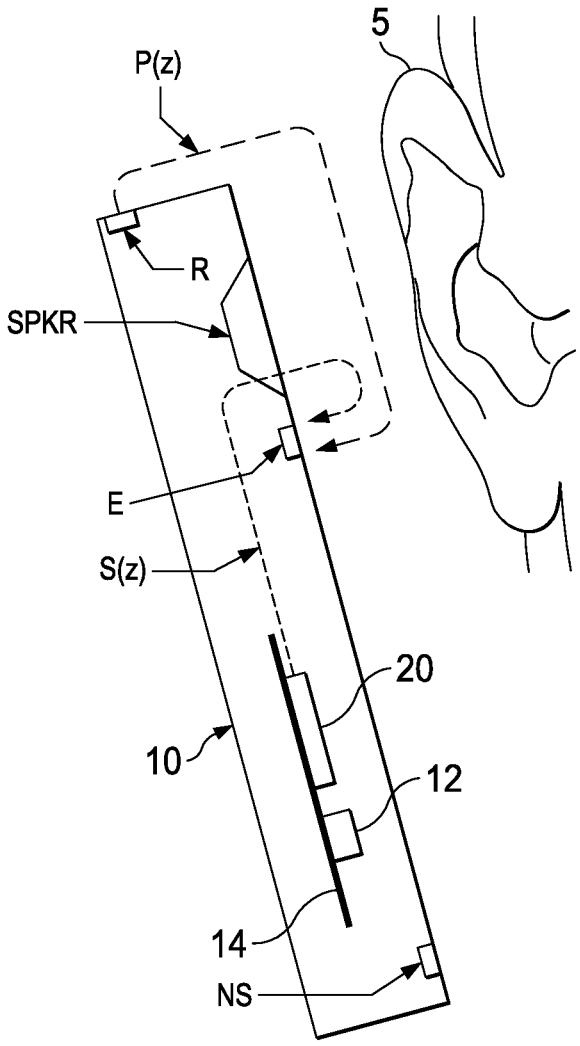
FIG. 1 is an illustration of a wireless mobile telephone, in accordance with embodiments of the present disclosure.

Referring now to FIG. 1, a wireless telephone 10 as illustrated in accordance with embodiments of the present disclosure is shown in proximity to a human ear 5. Wireless telephone 10 is an example of a device in which techniques in accordance with embodiments of the invention may be employed, but it is understood that not all of the elements or configurations embodied in illustrated wireless telephone 10, or in the circuits depicted in subsequent illustrations, are required in order to practice the invention recited in the claims. Wireless telephone 10 may include a transducer such as speaker SPKR that reproduces distant speech received by wireless telephone 10, along with other local audio events such as ringtones, stored audio program material, injection of near-end speech (i.e., the speech of the user of wireless telephone 10) to provide a balanced conversational perception, and other audio that requires reproduction by wireless telephone 10, such as sources from webpages or other network communications received by wireless telephone 10 and audio indications such as a low battery indication and other system event notifications. A near-speech microphone NS may be provided to capture near-end speech, which is transmitted from wireless telephone 10 to the other conversation participant(s).

Wireless telephone 10 may include ANC circuits and features that inject an anti-noise signal into speaker SPKR to improve intelligibility of the distant speech and other audio reproduced by speaker SPKR. A reference microphone R may be provided for measuring the ambient acoustic environment, and may be positioned away from the typical position of a user's mouth, so that the near-end speech may be minimized in the signal produced by reference microphone R. Another microphone, error microphone E, may be provided in order to further improve the ANC operation by providing a measure of the ambient audio combined with the audio reproduced by speaker SPKR close to ear 5, when wireless telephone 10 is in close proximity to ear 5. Circuit 14 within wireless telephone 10 may include an audio CODEC integrated circuit (IC) 20 that receives the signals from reference microphone R, near-speech microphone NS, and error microphone E and interfaces with other integrated circuits such as a radio-frequency (RF) integrated circuit 12 having a wireless telephone transceiver. In some embodiments of the disclosure, the circuits and techniques disclosed herein may be incorporated in a single integrated circuit that includes control circuits and other functionality for implementing the entirety of the personal audio device, such as an MP3 player-on-a-chip integrated circuit.

In general, ANC techniques of the present disclosure measure ambient acoustic events (as opposed to the output of speaker SPKR and/or the near-end speech) impinging on reference microphone R, and by also measuring the same ambient acoustic events impinging on error microphone E, ANC processing circuits of wireless telephone 10 adapt an anti-noise signal generated from the output of reference microphone R to have a characteristic that minimizes the amplitude of the ambient acoustic events at error microphone E. Because acoustic path P(z) extends from reference microphone R to error microphone E, ANC circuits are effectively estimating acoustic path P(z) while removing effects of an electro-acoustic path S(z) that represents the response of the audio output circuits of CODEC IC 20 and the acoustic/electric transfer function of speaker SPKR including the coupling between speaker SPKR and error microphone E in the particular acoustic environment, which may be affected by the proximity and structure of ear 5 and other physical objects and human head structures that may be in proximity to wireless telephone 10, when wireless telephone 10 is not firmly pressed to ear 5. While the illustrated wireless telephone 10 includes a two-microphone ANC system with a third near-speech microphone NS, some aspects of the present invention may be practiced in a system that does not include separate error and reference microphones, or a wireless telephone that uses near-speech microphone NS to perform the function of the reference microphone R. Also, in personal audio devices designed only for audio playback, near-speech microphone NS will generally not be included, and the near-speech signal paths in the circuits described in further detail below may be omitted, without changing the scope of the disclosure, other than to limit the options provided for input to the microphone covering detection schemes.

Figure 2:
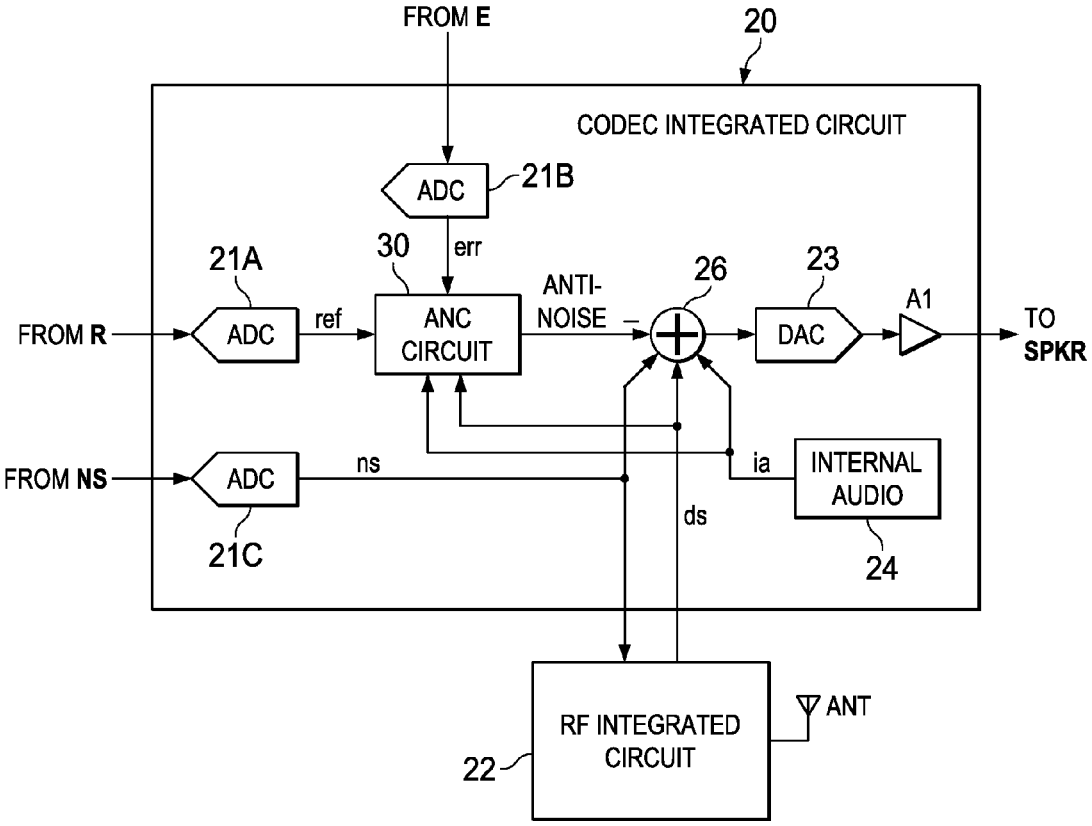
FIG. 2 is a block diagram of selected circuits within the wireless telephone depicted in FIG. 1, in accordance with embodiments of the present disclosure.

Referring now to FIG. 2, selected circuits within wireless telephone 10 are shown in a block diagram. CODEC IC 20 may include an analog-to-digital converter (ADC) 21A for receiving the reference microphone signal and generating a digital representation ref of the reference microphone signal, an ADC 21B for receiving the error microphone signal and generating a digital representation err of the error microphone signal, and an ADC 21C for receiving the near speech microphone signal and generating a digital representation ns of the near speech microphone signal. CODEC IC 20 may generate an output for driving speaker SPKR from an amplifier A1, which may amplify the output of a digital-to-analog converter (DAC) 23 that receives the output of a combiner 26. Combiner 26 may combine audio signals is from internal audio sources 24, the anti-noise signal generated by ANC circuit 30, which by convention has the same polarity as the noise in reference microphone signal ref and is therefore subtracted by combiner 26, and a portion of near speech microphone signal ns so that the user of wireless telephone 10 may hear his or her own voice in proper relation to downlink speech ds, which may be received from radio frequency (RF) integrated circuit 22 and may also be combined by combiner 26. Near speech microphone signal ns may also be provided to RF integrated circuit 22 and may be transmitted as uplink speech to the service provider via antenna ANT.

Figure 3:
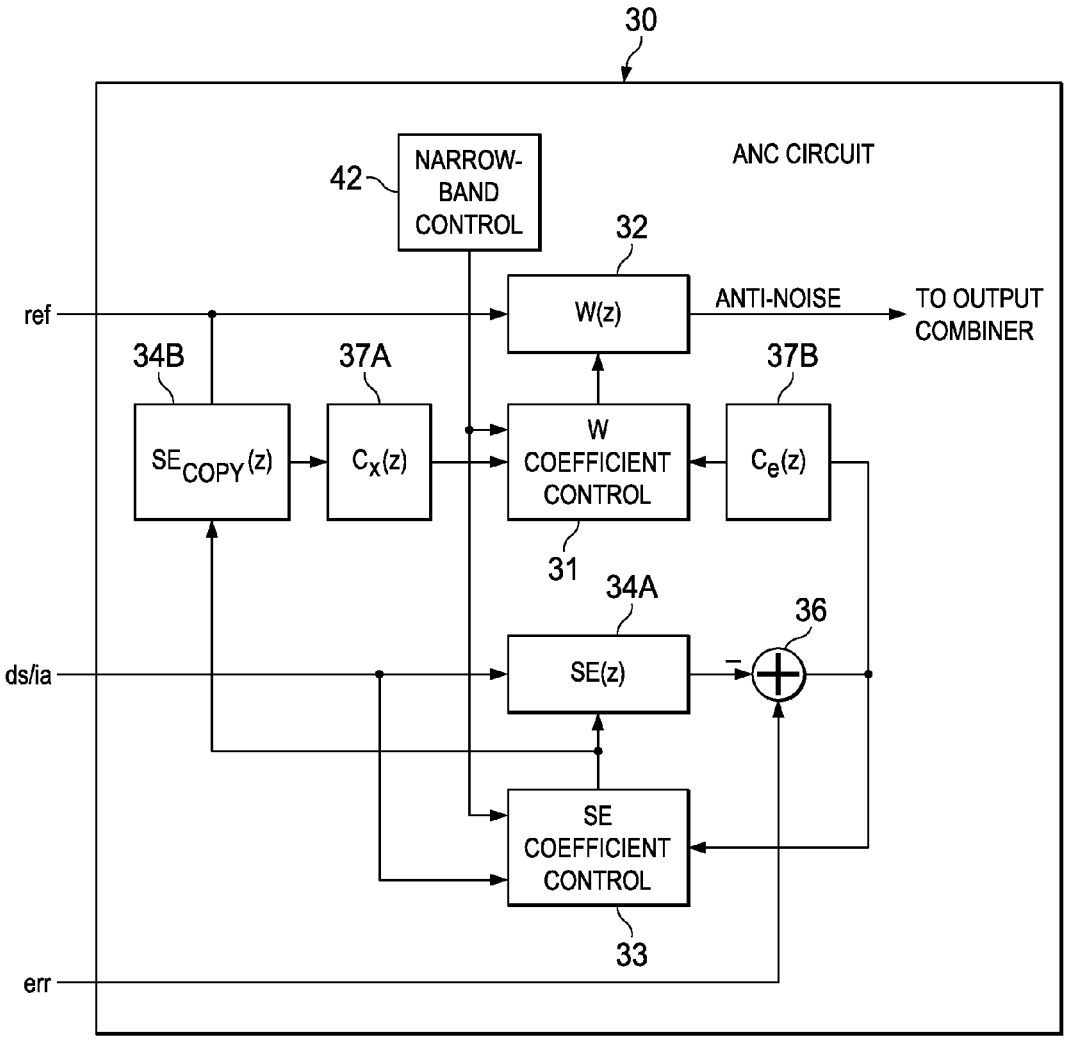
FIG. 3 is a block diagram depicting selected signal processing circuits and functional blocks within an active noise canceling (ANC) circuit of a coder-decoder (CODEC) integrated circuit of FIG. 3, in accordance with embodiments of the present disclosure.

Referring now to FIG. 3, details of ANC circuit 30 are shown in accordance with embodiments of the present disclosure. Adaptive filter 32 may receive reference microphone signal ref and under ideal circumstances, may adapt its transfer function W(z) to be P(z)/S(z) to generate the anti-noise signal, which may be provided to an output combiner that combines the anti-noise signal with the audio to be reproduced by the transducer, as exemplified by combiner 26 of FIG. 2. The coefficients of adaptive filter 32 may be controlled by a W coefficient control block 31 that uses a correlation of signals to determine the response of adaptive filter 32, which generally minimizes the error, in a least-mean squares sense, between those components of reference microphone signal ref present in error microphone signal err. The signals compared by W coefficient control block 31 may be the reference microphone signal ref as shaped by a copy of an estimate of the response of path S(z) provided by filter 34B and another signal that includes error microphone signal err. By transforming reference microphone signal ref with a copy of the estimate of the response of path S(z), response $SE_{COPY}$(z), and minimizing the difference between the resultant signal and error microphone signal err, adaptive filter 32 may adapt to the desired response of P(z)/S(z). In addition, a filter 37A that has a response $C_x(z)$ as explained in further detail below, may process the output of filter 34B and provide the first input to W coefficient control block 31. The second input to W coefficient control block 31 may be processed by another filter 37B having a response of $C_e(z)$. Response $C_e(z)$ may have a phase response matched to response $C_x(z)$ of filter 37A. Both filters 37A and 37B may include a highpass response, so that DC offset and very low frequency variation are prevented from affecting the coefficients of W(z). In addition to error microphone signal err, the signal compared to the output of filter 34B by W coefficient control block 31 may include an inverted amount of downlink audio signal ds and/or internal audio signal ia that has been processed by filter response SE(z), of which response $SE_{COPY}(z)$ is a copy. By injecting an inverted amount of downlink audio signal ds and/or internal audio signal ia, adaptive filter 32 may be prevented from adapting to the relatively large amount of downlink audio and/or internal audio signal present in error microphone signal err and by transforming that inverted copy of downlink audio signal ds and/or internal audio signal ia with the estimate of the response of path S(z), the downlink audio and/or internal audio that is removed from error microphone signal err before comparison should match the expected version of downlink audio signal ds and/or internal audio signal ia reproduced at error microphone signal err, because the electrical and acoustical path of S(z) is the path taken by downlink audio signal ds and/or internal audio signal ia to arrive at error microphone E. Filter 34B may not be an adaptive filter, per se, but may have an adjustable response that is tuned to match the response of adaptive filter 34A, so that the response of filter 34B tracks the adapting of adaptive filter 34A.

To implement the above, adaptive filter 34A may have coefficients controlled by SE coefficient control block 33, which may compare downlink audio signal ds and/or internal audio signal ia and error microphone signal err after removal of the above-described filtered downlink audio signal ds and/or internal audio signal ia, that has been filtered by adaptive filter 34A to represent the expected downlink audio delivered to error microphone E, and which is removed from the output of adaptive filter 34A by a combiner 36. SE coefficient control block 33 correlates the actual downlink speech signal ds and/or internal audio signal ia with the components of downlink audio signal ds and/or internal audio signal ia that are present in error microphone signal err. Adaptive filter 34A may thereby be adapted to generate a signal from downlink audio signal ds and/or internal audio signal ia, that when subtracted from error microphone signal err, contains the content of error microphone signal err that is not due to downlink audio signal ds and/or internal audio signal ia.

Narrow-band control block 42 of ANC circuit 30 may be configured to detect and cancel narrow-band noise, such as that which may be present due to sound vibrations between tires and a roadway when a user of wireless phone 10 or another personal audio device is listening to sound generated by an audio transducer while driving or traveling in a vehicle. To perform such functionality, narrow-band control block 42 may calculate a narrow-band-to-full-band ratio, wherein the narrow-band-to-full-band ratio is a function of a narrow-band power of the reference microphone signal occurring within a particular frequency range divided by a full-band power of the reference microphone signal. The particular frequency range may be any suitable band of interest for which it may be desirable to detect and cancel noise occurring in such particular frequency range. For example, in some embodiments, the particular frequency range may be between approximately 50 Hz and approximately 380 Hz, corresponding to noise that may be present due to travel in a vehicle. The higher the narrow-band-to-full-band ratio is, the less stable the adaptive system of ANC circuit 30 may be, thus leading to undesirable operation of ANC circuitry. Accordingly, based on the value of the narrow-band-to-full-band ratio, narrow-band control block 42 may generate control signals (not shown in FIG. 3) for controlling one or more other blocks of ANC circuit 30. For example, as the narrow-band-to-full-band ratio increases, narrow-band control block 42 may decrease the step size of the various coefficients for filters 32 and 34A, and vice versa. As another example, as the narrow-band-to-full-band ratio increases, narrow-band control block 42 may decrease the gain of one or more of filters 32 and 34A, and vice versa, by appropriately scaling the coefficients in accordance with the desired gain. To vary the gain of one or more filters 32 and 34A, approaches may be used similar or identical to those disclosed in U.S. patent application Ser. No. 13/333,484 filed Dec. 21, 2011 and titled "Bandlimiting Anti-Noise in Personal Audio Devices Having Adaptive Noise Cancellation (ANC)," which is incorporated by reference herein for all relevant purposes.

In its simplest form, the narrow-band-to-full-band ratio may be calculated as the narrow-band power divided by the full-band power. However, various approaches may be used to smooth the narrow-band-to-full-band ratio over time or increase its robustness by limiting or eliminating the effects of disturbances or outliers that may otherwise undesirably contribute to the narrow-band-to-full-band ratio calculation. For example, to smooth the narrow-band-to-full-band ratio over time, the narrow-band-to-full-band ratio may be calculated as:

$$NFR_n = \alpha NFR_{n-1} + (1-\alpha)(\text{Present Narrow-Band Power}/\text{Present Full-Band Power})$$

where $NFR_n$ is the value of the narrow-band-to-full-band ratio at a given discrete time interval n, $NFR_{n-1}$ is the value of the narrow-band-to-full-band ratio at a previous discrete time interval n−1, and α is a smoothing factor that determines the relative weight in the calculation for the narrow-band-to-full-band ratio at a previous discrete time interval n−1, such that as α increases, the response of the narrow-band-to-full-band ratio is smoother, and vice versa. Thus, the narrow-band-to-full-band ratio may be calculated as a blended average of a previous value of the narrow-band-to-full-band ratio and a quantity equal to a present narrow-band power of the reference microphone signal divided by a present full-band power of the reference microphone signal.

As another example, to improve the robustness of the narrow-band control block as compared to the calculation given above, the narrow-band-to-full-band ratio may be calculated as:

$$NFR_n=\alpha NFR_{n-1}+(1-\alpha)(\text{Present Narrow-Band Power}/\text{Adjusted Present Full-Band Power})$$

where the Adjusted Present Full-Band power equals the Present Full-Band Power of the reference microphone minus signal outliers present outside of the particular frequency range of the narrow-band power. Such signal outliers may be defined and/or identified in any suitable manner. For example, a signal outlier may comprise a signal at a particular frequency of the full-band power spectrum occurring outside of the narrow-band frequency range wherein the amplitude at such frequency is significantly larger (e.g., two times, 10 times, etc.) than the amplitude at neighboring frequencies. Thus, the narrow-band-to-full-band ratio is calculated as a blended average of a previous value of the narrow-band-to-full-band ratio and a quantity equal to a present narrow-band power of the reference microphone signal divided by a quantity equal to a present full-band power of the reference microphone signal minus a present power of reference microphone signal outliers present outside of a frequency range of the narrow-band power.

As another example, to improve the robustness of the narrow-band control block as compared to the calculation given above, the narrow-band-to-full-band ratio may be calculated as:

$$NFR_n=\alpha NFR_{n-1}+(1-\alpha)(\text{Present Narrow-Band Power}/\text{Adjusted Present Full-Band Power})$$

when no signal disturbances are detected during a discrete time interval n, and:

$$NFR_n=NFR_{n-1}$$

when a signal disturbance is detected during a discrete time interval n. As used herein, the term "signal disturbance" may include any sound impinging on the reference microphone that might be expected to falsely influence detection of narrow-band noise, and may include bursty speech or other sounds occurring close to the reference microphone, the presence of ambient wind, physical contact of an object with the reference microphone, a momentary tone, and/or any other similar sound. Such a disturbance may be detected by the reference microphone, another microphone, and/or any other sensor associated with the personal audio device.

This disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

All examples and conditional language recited herein are intended for pedagogical objects to aid the reader in understanding the invention and the concepts contributed by the inventor to furthering the art, and are construed as being without limitation to such specifically recited examples and conditions. Although embodiments of the present inventions have been described in detail, it should be understood that various changes, substitutions, and alterations could be made hereto without departing from the spirit and scope of the disclosure.

What is claimed is:

1. A personal audio device comprising:

a personal audio device housing;

a transducer coupled to the housing for reproducing an audio signal including both source audio for playback to a listener and an anti-noise signal for countering the effects of ambient audio sounds in an acoustic output of the transducer;

a reference microphone coupled to the housing for providing a reference microphone signal indicative of the ambient audio sounds;

an error microphone coupled to the housing in proximity to the transducer for providing an error microphone signal indicative of the acoustic output of the transducer and the ambient audio sounds at the transducer; and a processing circuit that implements an adaptive filter having a response that generates the anti-noise signal from the reference microphone signal to reduce the presence of the ambient audio sounds heard by the listener, wherein the processing circuit implements a coefficient control block that shapes the response of the adaptive filter in conformity with the error microphone signal and the reference microphone signal by adapting the response of the adaptive filter to minimize the ambient audio sounds in the error microphone signal and by further adapting the response of the adaptive filter in accordance with a calculated narrow-band-to-full-band ratio, wherein the narrow-band-to-full-band ratio is a function of a narrow-band power of the reference microphone signal divided by a full-band power of the reference microphone signal.

2. The personal audio device of claim 1, wherein the narrow-band-to-full-band ratio is calculated as a blended average of a previous value of the narrow-band-to-full-band ratio and a quantity equal to a present narrow-band power of the reference microphone signal divided by a present full-band power of the reference microphone signal.

3. The personal audio device of claim 1, wherein the narrow-band-to-full-band ratio is calculated as a blended average of a previous value of the narrow-band-to-full-band ratio and a quantity equal to a present narrow-band power of the reference microphone signal divided by a quantity equal to a present full-band power of the reference microphone signal minus a present power of reference microphone signal outliers present outside of a frequency range of the narrow-band power.

4. The personal audio device of claim 1, wherein:

the narrow-band-to-full-band ratio is calculated as a blended average of a previous value of the narrow-band-to-full-band ratio and a quantity equal to a present narrow-band power of the reference microphone signal divided by a present full-band power of the reference microphone signal responsive to a determination that no disturbance is detected on the reference microphone signal; and the narrow-band-to-full-band ratio is calculated as equal to the previous value of the narrow-band-to-full-band ratio reference microphone signal responsive to a determination that a disturbance is detected on the reference microphone signal.

5. The personal audio device of claim 1, wherein the narrow-band power comprises a power of the reference microphone signal for frequencies between approximately 50 Hz and approximately 380 Hz.

6. The personal audio device of claim 1, wherein the processing circuitry adapts the response of the adaptive filter in accordance with the calculated narrow-band-to-full-band ratio by controlling a step size of at least one coefficient of the coefficient control block based on the calculated narrow-band-to-full-band ratio.

7. The personal audio device of claim 1, wherein the processing circuitry adapts the response of the adaptive filter in accordance with the calculated narrow-band-to-full-band ratio by controlling an adaptive noise control gain of the adaptive filter based on the calculated narrow-band-to-full-band ratio.

8. The personal audio device of claim 1, wherein the narrow-band power of the reference microphone signal is attributable primarily to ambient noise caused by travel in a vehicle.

9. A method for canceling ambient audio sounds in the proximity of a transducer of a personal audio device, the method comprising:

receiving a reference microphone signal indicative of the ambient audio sounds;

receiving an error microphone signal indicative of the output of the transducer and the ambient audio sounds at the transducer;

adaptively generating an anti-noise signal, from a result of the measuring with the reference microphone and the measuring with the error microphone, for countering the effects of ambient audio sounds at an acoustic output of the transducer by adapting a response of an adaptive filter that filters an output of the reference microphone to minimize the ambient audio sounds in the error microphone signal, and further filters the output of the reference microphone in accordance with a calculated narrow-band-to-full-band ratio, wherein the narrow-band-to-full-band ratio is a function of a narrow-band power of the reference microphone signal divided by a full-band power of the reference microphone signal; and combining the anti-noise signal with a source audio signal to generate an audio signal provided to the transducer.

10. The method of claim 9, wherein the narrow-band-to-full-band ratio is calculated as a blended average of a previous value of the narrow-band-to-full-band ratio and a quantity equal to a present narrow-band power of the reference microphone signal divided by a present full-band power of the reference microphone signal.

11. The method of claim 9, wherein the narrow-band-to-full-band ratio is calculated as a blended average of a previous value of the narrow-band-to-full-band ratio and a quantity equal to a present narrow-band power of the reference microphone signal divided by a quantity equal to a present full-band power of the reference microphone signal minus a present power of reference microphone signal outliers present outside of a frequency range of the narrow-band power.

12. The method of claim 9, wherein:

the narrow-band-to-full-band ratio is calculated as a blended average of a previous value of the narrow-band-to-full-band ratio and a quantity equal to a present narrow-band power of the reference microphone signal divided by a present full-band power of the reference microphone signal responsive to a determination that no disturbance is detected on the reference microphone signal; and the narrow-band-to-full-band ratio is calculated as equal to the previous value of the narrow-band-to-full-band ratio reference microphone signal responsive to a determination that a disturbance is detected on the reference microphone signal.

13. The method of claim 9, wherein the narrow-band power comprises a power of the reference microphone signal for frequencies between approximately 50 Hz and approximately 380 Hz.

14. The method of claim 9, wherein adapting the response of the adaptive filter in accordance with the calculated narrow-band-to-full-band ratio comprises controlling a step size of at least one coefficient of the coefficient control block based on the calculated narrow-band-to-full-band ratio.

15. The method of claim 9, wherein adapting the response of the adaptive filter in accordance with the calculated narrow-band-to-full-band ratio comprises controlling an adaptive noise control gain of the adaptive filter based on the calculated narrow-band-to-full-band ratio.

16. The method of claim 9, wherein the narrow-band power of the reference microphone signal is attributable primarily to ambient noise caused by travel in a vehicle.

17. An integrated circuit for implementing at least a portion of a personal audio device, comprising:

an output for providing a signal to a transducer including both source audio for playback to a listener and an anti-noise signal for countering the effect of ambient audio sounds in an acoustic output of the transducer;

a reference microphone input for receiving a reference microphone signal indicative of the ambient audio sounds;

an error microphone input for receiving an error microphone signal indicative of the output of the transducer and the ambient audio sounds at the transducer; and a processing circuit that implements an adaptive filter having a response that generates the anti-noise signal from the reference microphone signal to reduce the presence of the ambient audio sounds heard by the listener, wherein the processing circuit implements a coefficient control block that shapes the response of the adaptive filter in conformity with the error microphone signal and the reference microphone signal by adapting the response of the adaptive filter to minimize the ambient audio sounds in the error microphone signal and further adapting the response of the adaptive filter in accordance with a calculated narrow-band-to-full-band ratio, wherein the narrow-band-to-full-band ratio is a function of a narrow-band power of the reference microphone signal divided by a full-band power of the reference microphone signal.

18. The integrated circuit of claim 17, wherein the narrow-band-to-full-band ratio is calculated as a blended average of a previous value of the narrow-band-to-full-band ratio and a quantity equal to a present narrow-band power of the reference microphone signal divided by a present full-band power of the reference microphone signal.

19. The integrated circuit of claim 17, wherein the narrow-band-to-full-band ratio is calculated as a blended average of a previous value of the narrow-band-to-full-band ratio and a quantity equal to a present narrow-band power of the reference microphone signal divided by a quantity equal to a present full-band power of the reference microphone signal minus a present power of reference microphone signal outliers present outside of a frequency range of the narrow-band power.

20. The integrated circuit of claim 17, wherein:

the narrow-band-to-full-band ratio is calculated as a blended average of a previous value of the narrow-band-to-full-band ratio and a quantity equal to a present narrow-band power of the reference microphone signal divided by a present full-band power of the reference microphone signal responsive to a determination that no disturbance is detected on the reference microphone signal; and the narrow-band-to-full-band ratio is calculated as equal to the previous value of the narrow-band-to-full-band ratio reference microphone signal responsive to a determination that a disturbance is detected on the reference microphone signal.

21. The integrated circuit of claim 17, wherein the narrow-band power comprises a power of the reference microphone signal for frequencies between approximately 50 Hz and approximately 380 Hz.

22. The integrated circuit of claim 17, wherein the processing circuitry adapts the response of the adaptive filter in accordance with the calculated narrow-band-to-full-band ratio by controlling a step size of at least one coefficient of the coefficient control block based on the calculated narrow-band-to-full-band ratio.

23. The integrated circuit of claim 17, wherein the processing circuitry adapts the response of the adaptive filter in accordance with the calculated narrow-band-to-full-band ratio by controlling an adaptive noise control gain of the adaptive filter based on the calculated narrow-band-to-full-band ratio.

24. The integrated circuit of claim 17, wherein the narrow-band power of the reference microphone signal is attributable primarily to ambient noise caused by travel in a vehicle.

* * * * *